United States Patent [19]

Sanvito

[11] Patent Number: 4,546,714

[45] Date of Patent: Oct. 15, 1985

[54] DUAL NEEDLE BAR SEWING MACHINE

[75] Inventor: Roberto Sanvito, Milan, Italy

[73] Assignee: Rockwell-Rimoldi S.p.A., Italy

[21] Appl. No.: 643,572

[22] Filed: Aug. 23, 1984

[30] Foreign Application Priority Data

Feb. 28, 1984 [IT] Italy ..... 19822 A/84

[51] Int. Cl.[4] ..... D05B 55/14

[52] U.S. Cl. ..... 112/155; 112/220

[58] Field of Search ..... 112/155, 163, 165, 167, 112/221, 220

[56] References Cited

U.S. PATENT DOCUMENTS

| | | | |
|---|---|---|---|
| 3,077,846 | 2/1963 | Bono | 112/221 |
| 3,913,508 | 10/1975 | Boser | 112/221 |
| 4,445,450 | 5/1984 | Ebata | 112/155 |
| 4,473,018 | 9/1984 | Shimoda et al. | 112/163 |
| 4,474,124 | 10/1984 | Yamazawa | 112/167 |
| 4,478,161 | 10/1984 | Hanyu et al. | 112/155 |
| 4,485,751 | 12/1984 | Ronchi et al. | 112/163 |

FOREIGN PATENT DOCUMENTS

| | | | |
|---|---|---|---|
| 2900804 | 7/1980 | Fed. Rep. of Germany | 112/155 |

*Primary Examiner*—Werner H. Schroeder
*Assistant Examiner*—Andrew M. Falik

[57] ABSTRACT

A sewing machine utilizing two needle rods driven by separated coaxial drive shafts and means for selectively interconnecting the two coaxial drive shafts. The means connecting the drive shafts can be selectively disengaged by means of an electromagnet depending upon whether it is desired to operate one or both of the needle rods at the same time.

6 Claims, 7 Drawing Figures

DUAL NEEDLE BAR SEWING MACHINE

BACKGROUND OF THE INVENTION

The present invention relates to a sewing machine provided with two needle rods or bars and a device for engaging and disengaging the two shafts connecting the respective needle rods of the sewing machine, so that both the needle rods receive the known alternating movement or one of these does not receive the said movement, depending on whether the said device is in the engaged or disengaged position.

In this way, using only one machine, it is possible to perform two lines of stitches at a distance from each other on an article of clothing and interrupt one of the said lines of stitches for any chosen section. In particular, it is possible to start with a single line of stitches performed by one needle rod while the other one remains disengaged for a certain section, after which it is possible to continue with both the lines of stitches.

The above cannot be achieved using two-needle sewing machines of the known art. Instead, a sewing machine with one needle is used, performing, in a known manner, one line of stitches at a time and hence taking twice as much time.

The object and technical problem of the present invention have been previously those of designing a sewing machine with two needles which is provided with a device such that it is able to perform two lines of stitches simultaneously, with the possibility of interrupting one of them for any chosen sections, that is, by disengaging one needle rod with respect to the other one.

Figure 1:
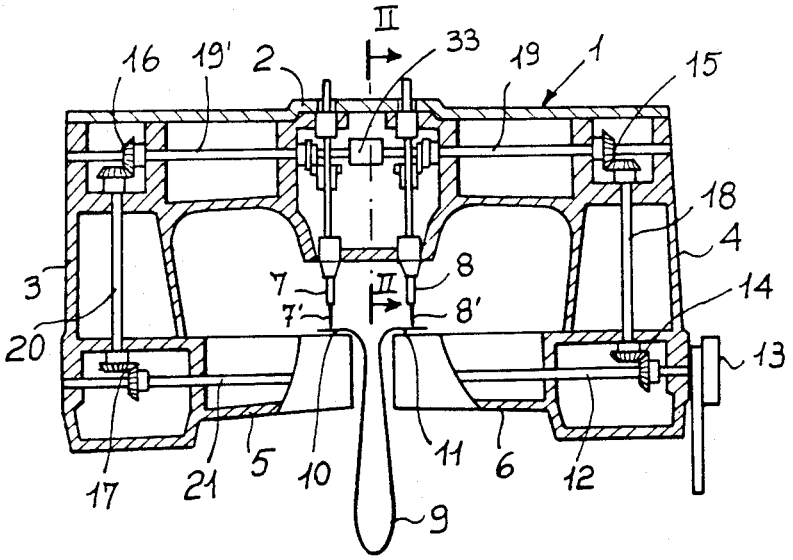
Figure 2:
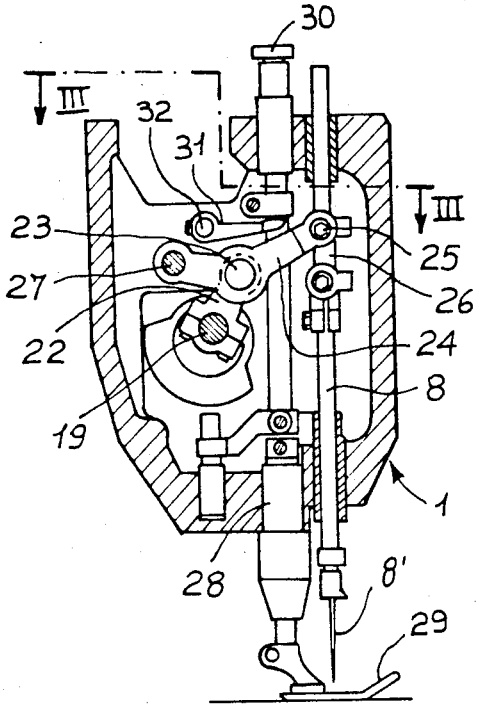
Figure 6:
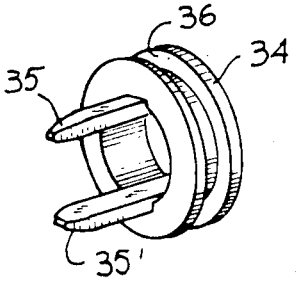
Figure 7:
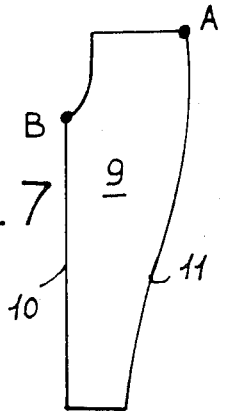
Figure 3:
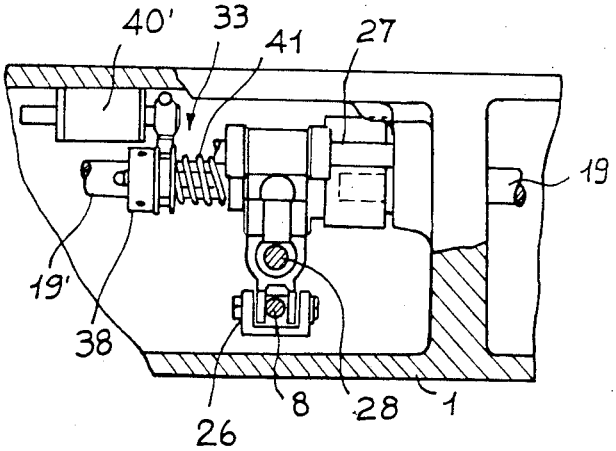
Figure 4:
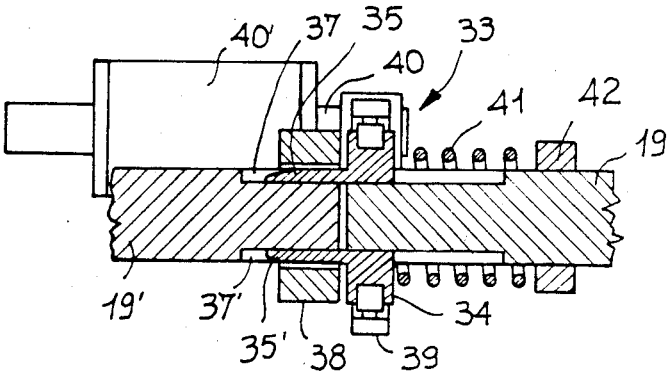
Figure 5:
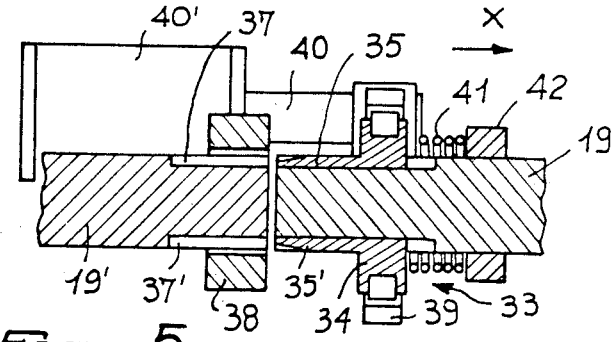

This technical problem has been solved with the sewing machine whose characteristics are contained in the claims relating to the description which follows, given purely by way of example and illustrated in the attached drawings in which, FIG. 1 shows a vertical section through a sewing machine provided with the engaging and disengaging device, FIG. 2 shows the section according to the line II—II of FIG. 1, FIG. 3 shows the section according to the line III—III of FIG. 2, FIGS. 4 and 5 show a sectional view of the said device in the engaged and disengaged positions, respectively, FIG. 6 is a detail of the said device in perspective, and FIG. 7 shows in diagrammatic form the article of clothing which is to be stitched along its opposite edges.

DESCRIPTION OF THE INVENTION

With reference to FIG. 1, the housing 1 of the sewing machine in question consists of the head-piece 2 connected to the two vertical columns 3, 4, which are in turn fixed to the flat base-plates 5 and 6, respectively. The head-piece 2 supports the two needle rods 7 and 8 to which the needles 7' and 8', respectively, are fixed, the latter cooperating to form the stitch with the other stitching elements, such as the hooks and feed elements, these being means which are not shown in the Figure, but are known, and are supported by the base-plates 5 and 6.

The said base-plates 5 and 6 are arranged at a distance from each other in such a way that the article 9 can be placed freely in the space formed between the said base-plates. with its edges 10 and 11 aligned with the needles 7' and 8'.

The actuating mechanism for the various stitching elements, which consist of the needle rods 7 and 8 and the hooks and feed elements not shown, receives the movement from a main shaft 12 fixed to the handwheel 13 which in turn is connected, in a known manner, to an electric motor not shown in the Figures.

The pairs of bevel gears 14, 15, 16 and 17 transmit the movement from the shaft 12 to the shafts 18, 19, 19', 20 and 21, respectively, which in turn transmit the movement to the needle rods 7 and 8 and to the hooks and feed elements not shown.

The distance between the two base-plates 5 and 6 is such that it is the minimum suitable for inserting and passing between them the article 9 to be stitched, thereby making it possible to stitch articles of unlimited width, from the largest ones, such as sheets, to the smallest ones, such as strips of material.

In particular, the connection between the shaft 19 and the needle rod 8 is shown in FIG. 2, in which the crank 22 rotating with the shaft 19 is hinged at 23 with the small connecting rod 24, the latter being on the one side hinged at 25 with the sleeve 26 embracing the needle rod 8 and on the other side hinged at 27 with the housing 1 of the machine. The known presser bar 28 cooperates with the needle rod 8 and is provided with the presser foot 29 and button 30 for adjusting the pressure of the foot itself on the workpiece. The said presser bar 28 can be raised in a known manner by means of the lever 31 which is hinged at 32 with the housing 1.

The engaging and disengaging device 33, which is located between the drive shaft 19 and the driven shaft 19', consists of the ring 34 which is mounted in sliding fashion on the shaft 19, rotates integrally with the latter and is provided with two keys 35 and 35' and with a circular groove 36 which is concentric with respect to the common axis of the two coaxial shafts 19 and 19'. The two keys 35 and 35' have different dimensions to prevent them from mutually changing position with respect to the driven shaft 19' so as to ensure that the two moving parts of the machine are perfectly synchronized. Two slots 37, 37' are provided on the shaft 19', each of which has dimensions corresponding to only one of the said keys 35, 35'. They are closed at the top by the bush 38 fixed to the shaft 19' itself. The fork 39 is inserted in sliding fashion inside the said circular groove 36 and is integral with the rod 40 of the actuating means consisting, for example, of the simple-action electromagnet 40', so that when the latter is energized it moves the fork 39 in the direction of the arrow X with the keys 35 and 35' in the disengaged position (see FIG. 5), that is, outside of the corresponding slots 37 and 37'.

When the said electromagnet 40' is de-energized, the ring 34 is pushed in the direction opposite to the arrow X by means of the spring 41 wound on the shaft 19 and compressed between the said ring 34 and the bush 42 fixed to the shaft 19. In this way, the keys 35 and 35' are inserted into the corresponding slots 37 and 37' only in the corrected engaged position, as a result of which the two shafts 19 and 19' become integral with each other again (see FIG. 4) in the only angular position permitted, that is, in the position in which the two groups of the stitching elements perform the same operating phase in synchronization. The said keys are appropriately chamfered at their ends to facilitate insertion in the respective slots.

Correct insertion of the keys in the appropriate slots is obtained automatically since, when the drive shaft 19 rotates integrally with the ring 34, it is the spring 41 which pushes the keys inside the slots when the larger-sized key is located opposite the similar larger-sized slot.

If, for example, it is required to perform two lines of stitches along the edges 10 and 11 of the article 9 shown in FIG. 7, which represents a quarter section of a pair of trousers, starting from the point A and B not located on the same line joining the two needles 7' and 8', the device 33 is disengaged and the electromagnet 40' is energized at the start of stitching, so that, whereas the needle 8' performs the line of stitches along the section of the edge 11, the needle 7' does not start stitching until point B is reached, at which point the electromagnet 40' is de-energized so that the spring 41 causes the keys 35 and 35' to enter inside the respective slots, thereby coupling the shaft 19 with the shaft 19'. At this point not only the needle rod 8 but also the needle rod 7 and the stitching elements associated with it are actuated, since the latter are connected to the driven shaft 19', and thus the two lines of stitches are performed simultaneously along the edges 10 and 11.

If the article 9 has a distance between the edges 10 and 11 which is greater than the distance between the centers of the needle rods 7 and 8, the article itself is arranged as shown in FIG. 1 in the space between the base-plates 5 and 6 located at a distance from each other.

This engaging and disengaging device 33 can be applied to any sewing machine provided with two needle rods, but is particularly useful if applied to a machine which has a bridge-type structure as described above, that is, two base-plates 5 and 6 arranged at a distance from each other and a driven shaft 19' which is connected not only to its needle rod 7 but also to the stitching elements cooperating with this needle rod. In this way it is possible to stitch the edges of the article, the distance of which may be greater than the distance between the centres of the needle rods, and, when the device 33 is disengaged, the needle rod 7 stops functioning, which is the condition required to prevent stitching on the edge 10 of the article 9, but, in addition, the shafts 19', 20 and 21 stop functioning, along with the other stitching elements which are located in the base-plate 5 and cooperate with the needle rod 7 itself.

The description given above refers to an exemplary embodiment of a sewing machine, which can be modified or varied without, however, going outside the scope of the present invention characterized by the claims which follow.

I claim:

1. In a sewing machine the combination comprising: a pair of needle rods, mounted for reciprocal movement, a drive shaft operably connected to each of said needle rods and one of said shafts being operable connected to a drive source, and selectively operable clutch means connecting said drive shafts whereby only one of said shafts and its associated needle rod will be operated when desired or both shafts and their associated needle rods can be simultaneously operated when desired.

2. A sewing machine as defined in claim 1, wherein the said clutch means consists of a ring slidably disposed on one of said drive shafts, said ring being provided with at least two keys for engagement mating slots provided on the other said shaft.

3. Sewing machine as claimed in claim 2, wherein said drive shafts are coaxially mounted, said ring has a circular groove in its outer periphery which is concentric with respect to the common axis of the two said shafts a yoke desposed within said groove; and linear drive means connected to said yoke to effect movement thereof to thereby engage the keys in and disengage them from the slots.

4. Sewing machine as claimed in claim 3, wherein the said actuating means consists of a linear motor which, when energized, moves the said yoke and hence the keys into disengaged position, and wherein spring means is provided adjacent said ring so that when said motor is de-energized, the keys are pushed into the engaged position.

5. Sewing machine as claimed in claim 2, wherein said slots have different dimensions with respect to each other and wherein on said ring with said two keys have the same dimensions as said slots, so that said keys can be inserted only in the corresponding lots, thereby ensuring correct synchronization between the needle rods and the respective stitching elements.

6. Sewing machine as defined in claim 2 wherein said keys are appropriately chamfered at their ends to facilitate insertion in the respective said slots.

* * * * *